US008622679B2

(12) United States Patent
Jette

(10) Patent No.: US 8,622,679 B2
(45) Date of Patent: Jan. 7, 2014

(54) SPEED FASTENER

(76) Inventor: Roger Jette, West Islip, NY (US)

( * ) Notice: Subject to any disclaimer, the term of this patent is extended or adjusted under 35 U.S.C. 154(b) by 138 days.

(21) Appl. No.: 13/350,440

(22) Filed: Jan. 13, 2012

(65) Prior Publication Data

US 2013/0181103 A1 Jul. 18, 2013

(51) Int. Cl.
*F16B 37/16* (2006.01)

(52) U.S. Cl.
USPC ..... 411/437; 248/74.1

(58) Field of Classification Search
USPC ..... 411/432, 433, 437; 248/74.1, 74.4; 292/305
See application file for complete search history.

(56) References Cited

U.S. PATENT DOCUMENTS

| | | | | | |
|---|---|---|---|---|---|
| 1,106,096 | A | | 8/1914 | Hunt | |
| 2,066,541 | A | * | 1/1937 | Schenk | 411/437 |
| 2,153,474 | A | | 4/1939 | Naylor et al. | |
| 2,736,227 | A | | 2/1956 | Stroble | |
| 3,038,366 | A | * | 6/1962 | Hindman | 411/433 |
| 3,708,145 | A | * | 1/1973 | Pestka | 248/499 |
| 4,048,897 | A | | 9/1977 | Price, Jr. | |
| 4,125,049 | A | | 11/1978 | Price, Jr. | |
| 4,132,146 | A | * | 1/1979 | Uhlig | 411/433 |
| 4,521,144 | A | * | 6/1985 | Ginter | 409/218 |
| 4,802,804 | A | | 2/1989 | Hirohata | |
| 4,978,261 | A | | 12/1990 | Wright, III | |
| 5,118,237 | A | | 6/1992 | Wright | |
| 5,324,150 | A | | 6/1994 | Fullerton | |
| 5,800,108 | A | | 9/1998 | Cabahug | |
| 5,967,008 | A | * | 10/1999 | Daniels | 82/153 |
| 6,062,791 | A | * | 5/2000 | Simon | 411/535 |
| 6,146,076 | A | * | 11/2000 | Bodin | 411/433 |
| 7,431,252 | B2 | | 10/2008 | Birli et al. | |

* cited by examiner

*Primary Examiner* — Gary Estremsky
(74) *Attorney, Agent, or Firm* — Carter, DeLuca, Farrell & Schmidt, LLP

(57) ABSTRACT

A fastener includes a body defining a central aperture and an insertion opening in communication with the central aperture. The body includes a threaded inner surface defining at least a portion of the central aperture and extending approximately 180 degrees about the central aperture. The body further defines a transverse aperture extending radially inwardly from an outer peripheral surface of the body in general alignment with the transverse aperture and in communication with the central aperture. An engagement screw is selectively engagable within the transverse aperture of the body and is movable relative to the body between a retracted position, wherein the engagement screw is disposed within the transverse aperture, and an extended position, wherein the engagement screw extends radially inwardly towards the threaded inner surface of the body for engaging a threaded rod within the central aperture of the body between the threaded inner surface and the engagement screw.

26 Claims, 3 Drawing Sheets

SPEED FASTENER

BACKGROUND

1. Technical Field

The present disclosure relates generally to threaded rods and fasteners and, more particularly, to a threaded fastener configured for rapid engagement about a threaded rod at any position therealong.

2. Description of Related Art

Threaded rods and fasteners are commonly used to facilitate the suspension of signage, equipment, cable trays, and other items from a ceiling or other supporting structure. Typically, the item to be suspended is positioned such that the threaded rod extends through an engagement aperture of the item. The fastener is then threaded onto the rod from the free end of the rod and is moved into position adjacent the item to retain the item in a desired position relative to the rod. As can be appreciated, such a procedure is relatively quick in instances where the item is to be attached towards the free end of the rod. However, where the item is to be suspended further up on the rod, the user is required to thread the fastener onto the rod and rotate the fastener to move the fastener up the rod to the desired position. This is a slow and arduous process, particularly considering the cumulative effort required to suspend an item from multiple rods.

Various fasteners have been developed that obviate the need to engage and rotate the fastener relative to the rod to translate the fastener axially along the rod to the desired position. However, while many of these fasteners succeed in reducing the time and effort required to engage the fasteners about the rod at a desired position, it is often the case that this reduced time and effort comes at the price of reduced holding strength. As such, users needing to suspend heavier equipment or signage, cable trays supporting a plurality of cables therein, or other relatively heavy items, are relegated to the use of conventional fasteners.

It would therefore be desirable to provide a fastener that is configured for rapid engagement about a threaded rod at any axial position therealong and that provides a holding strength at least as great as the equivalent conventional fasteners.

SUMMARY

In accordance with the present disclosure, a fastener for engagement about a threaded rod is provided. The fastener includes a body defining a central aperture therethrough and an insertion opening defined therethrough in communication with the central aperture. The body includes a threaded inner surface defining at least a portion of the central aperture. The threaded inner surface extends approximately 180 degrees about the central aperture. The body further defines a transverse aperture extending radially inwardly from an outer peripheral surface of the body in general alignment with the transverse aperture and in communication with the central aperture. An engagement screw is selectively engagable within the transverse aperture of the body and is movable relative to the body between a retracted position, wherein an inner end of the engagement screw is disposed within the transverse aperture of the body, and an extended position, wherein the inner end of the engagement screw extends radially inwardly towards the threaded inner surface of the body for centrally engaging a threaded rod within the central aperture of the body between the threaded inner surface of the body and the engagement screw. In the extended position, the engagement screw and the threaded inner surface are disposed in general opposition relative to one another to engage a threaded rod therebetween.

In one embodiment, the engagement screw is threadingly engaged within the transverse aperture.

In another embodiment, an outer end of the engagement screw includes a tool-receiving recess defined therein that is configured to receive an engagement tool to facilitate movement of the engagement screw between the retracted position and the extended position.

In another embodiment, the insertion opening defines a longitudinal axis that is offset relative to a radial line segment defined through the body and extending centrally through the transverse aperture by an oblique angle. The oblique angle may be about 45 degrees.

In another embodiment, the insertion opening includes a mouth that extends inwardly from the outer peripheral surface of the body into communication with the central aperture. The mouth is configured to facilitate insertion of a threaded rod therethrough and into the central aperture of the body.

In still another embodiment, the insertion opening includes an offset aperture partially overlapping the central aperture and offset from a center of the body. The offset aperture is generally aligned between the center of the body and the transverse aperture.

In yet another embodiment, the engagement screw, in the extended position, extends centrally through the offset aperture to centrally engage a rod within the central aperture between the threaded surface of the body and the engagement screw.

In still yet another embodiment, a groove is defined within and extends about the outer peripheral surface of the body. The groove may be configured to releasably engage a clip therein that is configured for positioning about an item suspended from the rod via the body of the fastener to substantially inhibit movement of the item relative to the rod.

A fastener provided in accordance with the present disclosure and configured for engagement about a rod includes a body defining an upper surface, a lower surface, and an outer peripheral surface. The body defines a central aperture that is centered about a center of the body and extends between the upper and lower surfaces thereof. The body also defines a mouth that extends inwardly from the outer peripheral surface thereof into communication with the central aperture. The body further defines a transverse aperture that extends radially inwardly from the outer peripheral surface thereof. The transverse aperture is disposed in communication with the central aperture and the mouth. The mouth is configured to facilitate insertion of a rod therethrough and into the central aperture of the body. The mouth extends inwardly from the outer peripheral surface of the body at an oblique angle, e.g., approximately 45 degrees, relative to a radial line segment defined through the body and extending centrally through the transverse aperture. An engagement screw is selectively engagable within the transverse aperture of the body and is movable relative to the body between a retracted position, wherein an inner end of the engagement screw is disposed within the transverse aperture of the body, and an extended position, wherein the inner end of the engagement screw extends radially inwardly into the mouth of the body to centrally engage a rod within the central aperture between an inner surface of the body that defines the central aperture and the inner end of the engagement screw.

In one embodiment, the engagement screw is threadingly engaged within the transverse aperture.

In one embodiment, an outer end of the engagement screw includes a tool-receiving recess defined therein that is configured to receive an engagement tool to facilitate movement of the engagement screw between the retracted position and the extended position.

In another embodiment, the inner surface of the body that defines the central aperture extends approximately 180 about the central aperture and is generally aligned with the transverse aperture such that the inner surface of the body and the engagement screw engage the rod therebetween in general opposition to one another.

In still another embodiment, the inner surface of the body that defines the central aperture is threaded to facilitate engagement with a threaded rod.

In yet another embodiment, an elbow is defined at the interface between the mouth and the central aperture of the body.

In still yet another embodiment, a groove is defined within and extends about the outer peripheral surface of the body. The groove may be configured to releasably engage a clip therein that is configured for positioning about an item suspended from the rod via the body of the fastener to substantially inhibit movement of the item relative to the rod.

A fastener assembly provided in accordance with the present disclosure and configured for suspending an item from a rod includes a fastener and a clip. The fastener is configured for positioning about a rod and is releasably engagable with the rod for retaining the fastener in fixed position relative to the rod. The clip includes a fastener-engaging portion configured for engagement about the fastener, a rod-engaging portion configured for engagement about the rod, and an connecting portion interconnecting the fastener-engaging portion and the rod-engaging portion. The clip is configured for positioning about an item suspended from the rod via the fastener to substantially inhibit movement of the item relative to the rod.

In embodiments, the fastener is configured similarly to any of the above embodiments.

In one embodiment, the fastener-engaging portion of the clip includes first and second resilient arms configured to snap into engagement within a groove defined within the fastener.

In another embodiment, the clip is formed from a single piece of wire.

BRIEF DESCRIPTION OF THE DRAWINGS

Various illustrative embodiments of the present disclosure are described herein with reference to the drawings wherein like reference numerals identify similar or identical elements.

DETAILED DESCRIPTION

Figure 1:
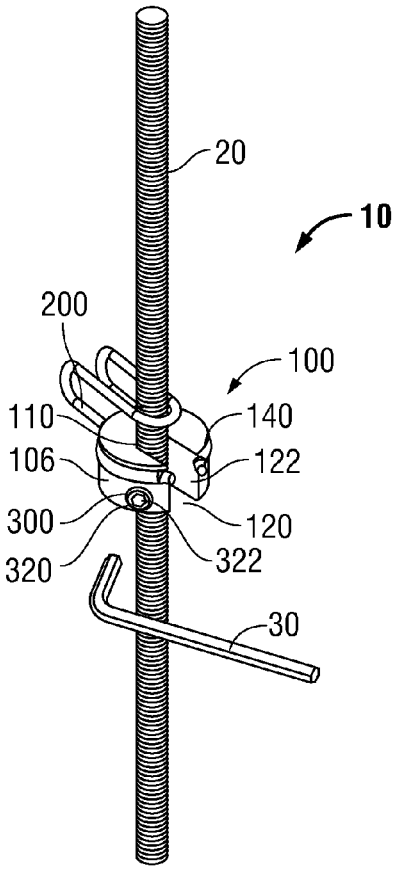
FIG. 1 is a perspective view of one embodiment of a fastener assembly provided in accordance with the present disclosure and shown engaged about a threaded rod.
Figure 2:
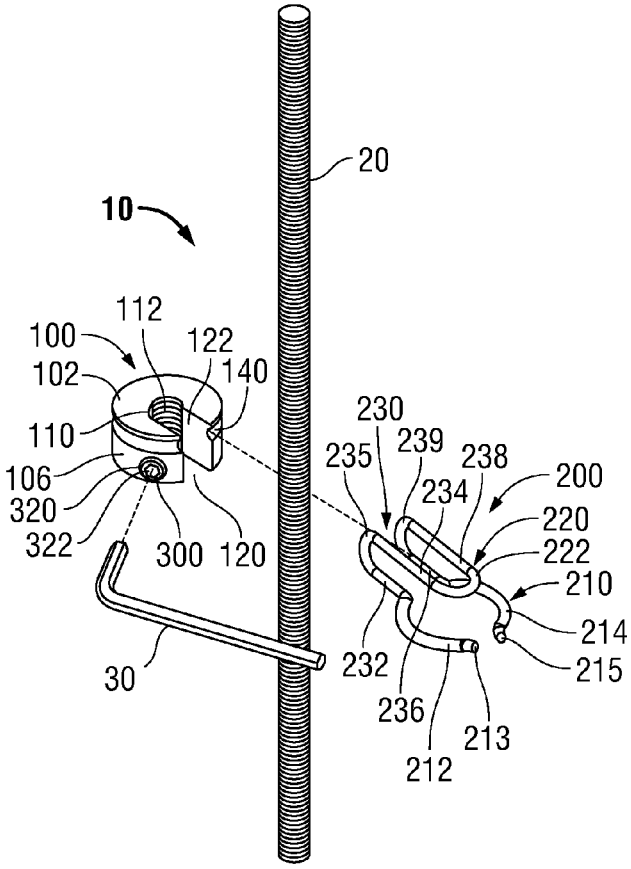
FIG. 2 is a perspective view of the fastener assembly and threaded rod of FIG. 1, wherein the fastener assembly is in a disassembled condition.
Figure 3:
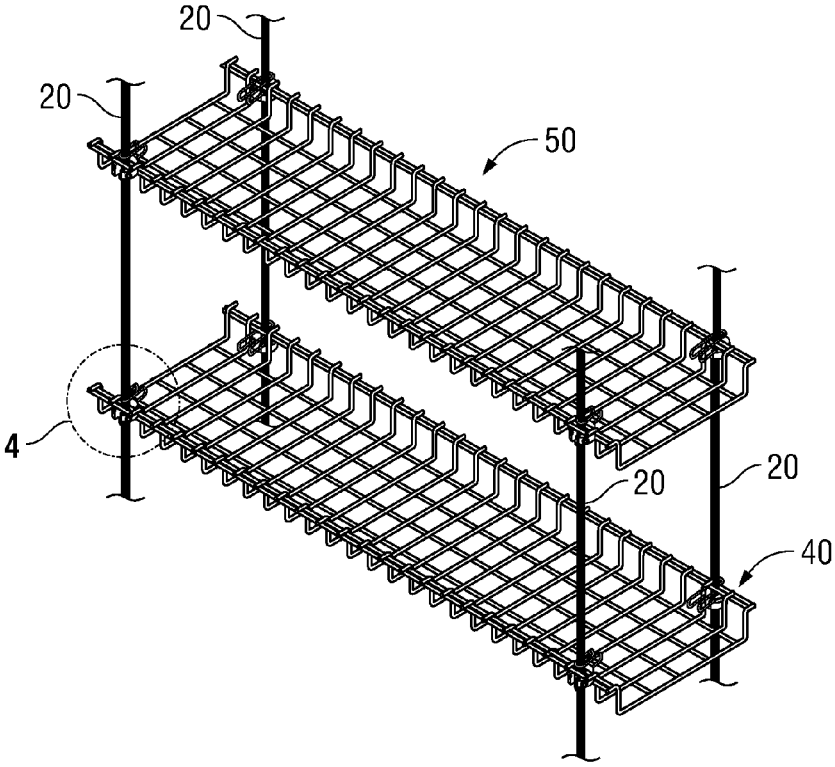
FIG. 3 is a perspective view of a pair of cable trays supported by a plurality of threaded rods.
Figure 4:
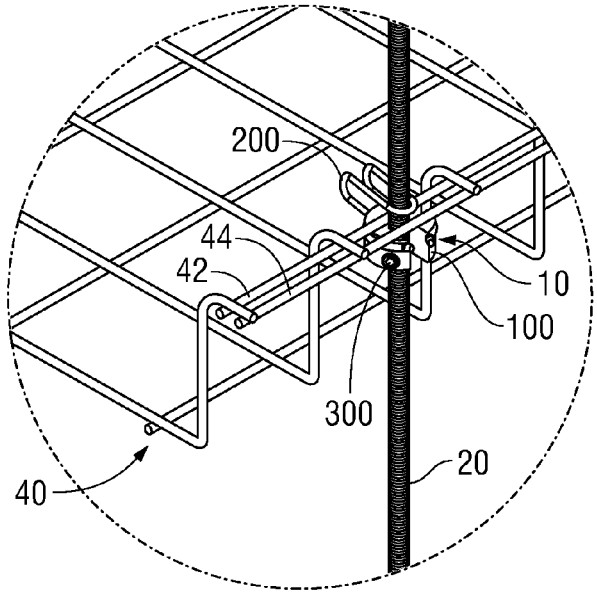
FIG. 4 is a greatly enlarged, perspective view of the area of detail indicated in FIG. 3.

Turning now to FIGS. 1-4, a fastener assembly provided in accordance with the present disclosure and configured for releasable engagement about a threaded rod 20 is shown generally identified by reference numeral 10. Fastener assembly 10 includes a fastener 100, a clip 200, and an engagement screw 300. An engagement tool 30 may also be provided to facilitate further engagement/disengagement of engagement screw 300 to engage/disengage fastener 100 about rod 20, as will be described in greater detail below. Fastener assembly 10, as shown in FIGS. 3-4, for example, may be configured to suspend one or more cable trays 40, 50 from rods 20, as shown in FIGS. 3-4, or may be used for engaging, e.g., suspending, any other suitable equipment, structure, or other item from a threaded rod 20.

Figure 5A:
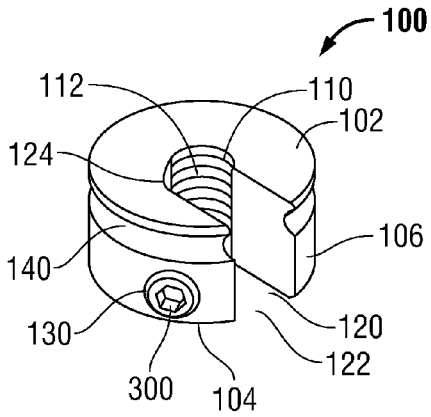
FIG. 5A is a perspective view of a fastener of the fastener assembly of FIG. 1.
Figure 5B:
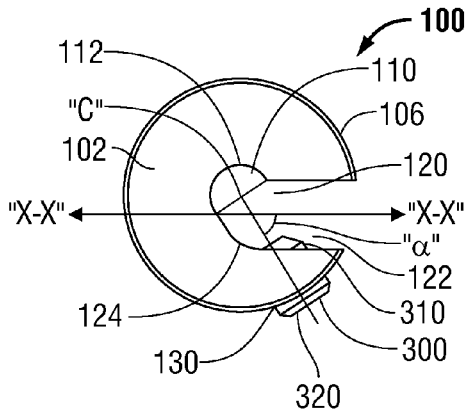
FIG. 5B is a top view of the fastener of FIG. 5A.
Figure 5C:
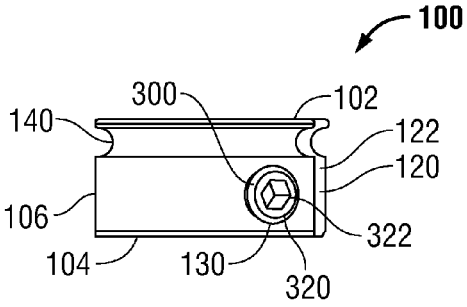
FIG. 5C is a side view of the fastener of FIG. 5A.

With reference to FIGS. 5A-5C, in conjunction with FIGS. 1-2, fastener 100 defines a generally disc-shaped configuration having first and second generally circular, planar surfaces 102, 104, respectively, and an annular outer peripheral surface 106, although other configurations are also contemplated. A central aperture 110 is defined through the center "C" of fastener 100 such that central aperture 110 and fastener 100 define a common center "C." Central aperture 110 extends between and is generally perpendicular to first and second surfaces 102, 104, respectively, of fastener 100. Further, the diameter of central aperture 110 generally approximates, or is slightly larger than the diameter of rod 20, and inner surface 112 of fastener 100 defined by central aperture 110 is threaded, to facilitate engagement of fastener 100 to rod 20, as will be described in greater detail below.

Fastener 100 further includes a cut-out, or mouth 120 defined therein that extends inwardly from outer peripheral surface 106 of fastener 100 and into communication with central aperture 110 so as to define a passage 122 for lateral insertion of rod 20 through mouth 120 and into central aperture 110 of fastener 100. Passage 122 defines a substantially uniform width along its length that is similar to or slightly larger than the diameter of central aperture 110. Further, passage 122 extends inwardly from outer peripheral surface 106 of fastener 100 in a non-radial direction, e.g., the longitudinal axis "X-X" of passage 122 is offset by an angle "$\alpha$" relative to a radial line segment extending from the center "C" of central aperture 110 and fastener 100 through transverse aperture 130, thereby defining an elbow 124 that interconnects passage 122 and central aperture 110 to one another. Angle "$\alpha$" may be about 45 degrees, although other angles are also contemplated. Due to this offset configuration, the about 180 degrees of threaded inner surface 112 of fastener 100 that defines central aperture 110 is positioned at an oblique angle "$\alpha$," e.g., 45 degrees offset, relative to the longitudinal axis "X-X" of passage 122, the importance of which will become more apparent below.

Continuing with reference to FIGS. 5A-5C, in conjunction with FIGS. 1-2, fastener 100 further includes a transverse aperture 130 defined through outer peripheral surface 106 thereof that extends radially inwardly through fastener 100 towards center "C" thereof in general opposition to the 180 degrees of threaded inner surface 112 of fastener 100 that defines central aperture 110. Transverse aperture 130 ultimately communicates with passage 122 and central aperture 110 and defines a threaded inner surface (not explicitly shown) configured to threadingly receive engagement screw 300 therein such that engagement screw 300 may be selectively further engaged/disengaged from transverse aperture 130 to engage/disengage fastener 100 about rod 20. Due to the above-described configuration of fastener 100, rod 20 is capable of being centrally engaged within central aperture 110 (and centrally disposed relative to fastener 100) while being retained therein via opposing engagement features, e.g., the 180 degrees of threaded inner surface 112 of central aperture 110 engaging the threading of rod 20 on one side thereof and engagement screw 300 engaging rod 20 on the other side thereof, that substantially engage rod 20 about the entire outer periphery thereof. Further, with engagement screw 300 extending through passage 122 and to central aperture 110 when in the extended position to engage rod 20 therein, passage 122 is substantially blocked by engagement screw 300. This configuration of fastener 100 provides increased holding strength to the engagement between fastener 100 and rod 20 and inhibits rod 20 from backing out of passage 122.

Screw 300, as mentioned above, is configured for threaded engagement within transverse aperture 130 of fastener 100. More specifically, screw 300 includes a threaded exterior surface (not explicitly shown) that is configured complementarily to the threaded interior surface (not explicitly shown) defining transverse aperture 130 of fastener 100 such that screw 300 may be selectively retained in any suitable position relative to transverse aperture 130, e.g., between a retracted position, wherein screw 300 does not protrude inwardly from transverse aperture 130 into passage 122, and an extended position, wherein screw 300 protrudes radially inwardly from transverse aperture 130, through passage 122, and to or into central aperture 110 of fastener 100 to engage rod 20 within central aperture 110 of fastener 100. As such, inner end 310 of screw 300 may define any suitable configuration to facilitate engagement with the threaded exterior surface of rod 20. Outer end 320 of screw 300, on the other hand, may define a tool-engagement recess 322, e.g., a hexagonal-shaped recess, configured to complementarily receive a hexagonal-shaped engagement tool 30 for selectively advancing or retracting engagement screw 300 through transverse aperture 130 and relative to fastener 100. Other suitable complementary engagement features for releasably engaging a complementary engagement tool with engagement screw 300 are also contemplated.

Referring to FIGS. 1-2, fastener 100 further includes an annular groove 140 defined within outer peripheral surface 106 thereof. Annular groove 140 defines a generally circular cross-sectional configuration and is configured to receive clip 200 therein to releasably engage clip 200 about fastener 100, although annular groove 140 may define any other suitable configuration for engaging a clip or other coupling component to fastener 100.

Clip 200 is formed from a single wire of material (although other configurations are contemplated) and generally includes a fastener-engaging portion 210, a rod-engaging portion 220, and a connecting portion 230 that interconnects fastener-engaging portion 210 and rod-engaging portion 220. Fastener-engaging portion 210 includes first and second resilient arms 212, 214, respectively, that are curved to define a generally-circular opening therebetween for receipt of fastener 100. Arms 212, 214 define cross-sectional configurations that are complementary to the cross-sectional configuration of annular groove 140 of fastener 100, e.g., both define circular cross-sectional configurations, and the generally-circular opening defined by arms 212, 214 is dimensioned so as to permit arms 212, 214 to substantially surround fastener 100 and to resiliently snap into engagement within annular groove 140, to thereby engage clip 20 about fastener 100. Arms 212, 214 may further include fingers 213, 215, respectively, extending from the free ends thereof to facilitate flexion of arms 212, 214 to engage/disengage clip 200 to/from fastener 100.

With continued reference to FIGS. 1-2, and in conjunction with FIGS. 3-4, connecting portion 230 of clip 200 includes a first pair of spaced-apart rails 232, 236 extending from arms 212, 214, respectively, a second pair of spaced-apart rails 234, 238 disposed above and vertically-spaced from first rails 232, 236, respectively, and a pair of generally U-shaped portion 235, 239 that interconnect respect rails 232, 234 and 236, 238. Connecting portion 230 of clip 200, as best shown in FIG. 4 and as will be described in greater detail below, is configured to transversely receive spine supports 42, 44 of cable tray 40 (or suitable structure of any component to be suspended from rod 20 via fastener 100 and clip 200) between the pairs of rails 232, 236 and 234, 238 thereof.

Rod-engaging portion 220 of clip 200 includes a U-shaped connector 222 that interconnects the ends of rails 234, 238 to one another and is vertically aligned with the generally-circular opening defined by arms 212, 214 such that rod 20, when engaged within fastener 100, extends between rails 234, 238 of rod-engaging portion 220 of clip 200 adjacent U-shaped connector 220 thereof. As can be appreciated, the above-described configuration of clip 200 inhibits substantial movement of cable tray 40 relative to rod 20 and fastener 100 without requiring rod 20 to be engaged to cable tray 40 on both the upper and lower sides thereof, e.g., without requiring a pair of fasteners 100 (although in some embodiments, above and below fasteners 100 may be provided, where necessary). More specifically, with fastener 100 engaged about rod 20 and clip 200 engaged about both fastener 100 and rod 20, support spines 42, 44 of cable tray 40 are retained in substantially fixed vertical position relative to rod 20 between fastener 100 and rod-engaging portion 220 of clip 200, and in substantially fixed lateral position between U-shaped portions 235, 239 of connecting portion 230 of clip 200 and fastener 100 and between rails 232, 236 and 234, 238 of clip 200.

Figure 6:
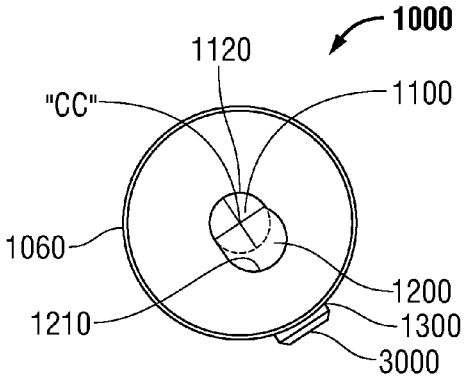
FIG. 6 is a top view of another embodiment of a fastener provided in accordance with the present disclosure and configured for engagement about a threaded rod.

Turning now to FIG. 6, another embodiment of a fastener provided in accordance with the present disclosure is shown generally identified by reference numeral 1000. Fastener 1000 is similar to fastener 100 (FIGS. 5A-5C) and may include any of the features thereof. Accordingly, only the differences between fastener 1000 and fastener 100 (FIGS. 5A-5C) will be described in detail below, while similarities will be only summarily described or omitted entirely for purposes of brevity.

Fastener 1000 includes a central aperture 1100 defined through the center "CC" of fastener 1000 such that central aperture 1100 and fastener 1000 define a common center "CC." Inner surface 1120 of fastener 1000 defined by central aperture 1100 is threaded to facilitate engagement of fastener 1000 to a threaded rod, e.g., rod 20 (FIGS. 1-2). Fastener 1000 further includes an offset aperture 1200 that partially overlaps central aperture 1100 such that offset aperture 1200 and central aperture 1100 are in communication with one another. More specifically, central aperture 1100 and offset aperture 1200 are overlapped such that the remaining about 180 degrees of threaded inner surface 1120 of fastener 1000 faces in the general direction of offset aperture 1100. Inner surface 1210 of fastener 1000 that defines offset aperture 1200 defines a generally-smooth configuration, e.g., is non-threaded, and defines a diameter sufficiently greater than rod 20 (FIGS. 1-2) such that fastener 1000 may be freely translated along rod 20 (FIGS. 1-2) to a desired position when rod 20 (FIGS. 1-2) is disposed within offset aperture 1200.

Fastener 1000 further includes a transverse aperture 1300 defined through outer peripheral surface 1060 thereof that extends radially inwardly through fastener 1000 towards center "CC'" thereof in general alignment with offset aperture 1300 and in general opposition to the 180 degrees of threaded inner surface 1120 of fastener 1000 that defines central aperture 1100. Transverse aperture 1300 is configured to threadingly receive an engagement screw 3000 therein such that engagement screw 3000 may be selectively further engaged/disengaged from transverse aperture 1300 to centrally engage rod 20 (FIGS. 1-2) within central aperture 1100 while being retained therein via opposing engagement features, e.g., the 180 degrees of threaded inner surface 1120 of central aperture 1100 engaging the threading of rod 20 (FIGS. 1-2) on one side thereof and engagement screw 3000 engaging rod 20 (FIGS. 1-2) on the other side thereof, that substantially engage rod 20 (FIGS. 1-2) about the entire outer periphery thereof. Fastener 1000 is otherwise similar to and may include any of the features of fastener 100 (FIGS. 5A-5C), described above.

Referring again to FIGS. 1-4, the installation and use of fastener assembly 10 for suspending cable tray 40 from rod 20 is described, although fastener assembly 10 may similarly be used for suspending/engaging any suitable item from/to rod 20. Obviously, different considerations apply depending on the particular item to be suspended from or engaged to rod 20; however, the general installation and use of fastener assembly 10 remains generally consistent regardless of the particular item used.

Initially, as shown in FIG. 2, fastener 100 is disengaged from rod 20 and clip 200 is disengaged from both fastener 100 and rod 20. Further, engagement screw 300 is initially disposed in the retracted position, wherein engagement screw 300 does not protrude inwardly into passage 122. In order to suspend cable tray 40 (FIGS. 3-4) from rod 20, rod 20 is first positioned between first and second spine supports 42, 44 of cable tray 40 (see FIGS. 3-4) and is advanced or translated along rod 20 to a desired position, e.g., the position shown in FIG. 3.

Referring additionally to FIGS. 3-4, with cable tray 40 disposed in the desired position, fastener 100 is inserted about rod 20 beneath first and second spine supports 42, 44 of cable tray 40. More specifically, rod 20 is inserted through mouth 120 and passage 122 of fastener 100 and into central aperture 110 thereof. Once rod 20 is positioned within central aperture 110 of fastener 100, engagement tool 30 may be engaged with engagement screw 300 and manipulated, e.g., rotated, to advance engagement screw 300 radially inwardly through transverse aperture 130 from the retracted position to the extended position. Engagement screw 300 is advanced radially inwardly through passage 122 and to or into central aperture 110 sufficiently so as to urge rod 20 into engagement with threaded inner surface 112 defining central aperture 110. In this engaged position, rod 20 is retained in engagement within threaded inner surface 112 via engagement screw 300.

Referring in particular to FIG. 4, in conjunction with FIGS. 1-2, with fastener 100 engaged about rod 20 beneath first and second spine supports 42, 44 of cable tray 40, cable tray 40 is suspended from rod 20. More specifically, with rod 20 extending between first and second spine supports 42, 44 of cable tray 40, and with fastener 100 engaged about rod 20 beneath spine supports 42, 44, cable tray 40 is inhibited from translating downwardly along rod 20 since fastener 100 defines a diameter greater than the opening defined between first and second spine supports 42, 44 of cable tray 40. That is, spine supports 42, 44 of cable tray 40 are seated atop fastener 100, thereby maintaining cable tray 40 in the desired position relative to rod 20.

With cable tray 40 suspended from rod 20, as described above, clip 200 is positioned about rod 20 and relative to first and second spine supports 42, 44 of cable tray 40 such that rod 20 is positioned adjacent U-shaped connector 222 of clip 200 between rails 234, 238 of clip 200 and such that first and second spine supports 42, 44 of cable tray 40 are positioned between the pairs of rails 232, 236 and 234, 238 adjacent U-shaped portions 235, 239 thereof. Subsequently or prior to positioning of clip 200 as described above, arms 212, 214 of clip 200 are resiliently flexed outwardly to pass about the outer peripheral surface 106 of fastener 100 and into engagement within annular groove 140 of fastener 100 to engage clip 200 to fastener 100. With clip 200 engaged about fastener 100, rod 20, and cable tray 40, cable tray 40 is inhibited from substantial movement, e.g., in the instance of vibrations or other movement of rod 20. That is, while fastener 100 inhibits cable tray 40 from moving downwardly relative to rod 20, cable tray 40 is still permitted to move upwardly along rod 20. Although gravity and the weight of cable tray 40 is typically sufficient to retain spine supports 42, 44 of cable tray 40 in vertical position abutting fastener 100, e.g., inhibiting upward movement of cable tray along rod 20, vibrations, movement, or other external forces acting on rod 20 or cable tray 40 may urge cable tray 40 to move in this manner. However, clip 200, due to its engagement about fastener 100 beneath spine supports 42, 44 of cable tray 40 and about rod 20 above spine supports 42, 44 of cable tray 40, inhibits substantial upward movement of cable tray 40 relative to rod 20.

In order to disengage cable tray 100 from rod 20, clip 200 is removed via flexing arms 212, 214 outwardly to disengage clip 200 from fastener 100 and is then manipulated relative to first and second spine supports 42, 44 of cable tray 40 and rod 20 to disengage clip 20 therefrom. Next, engagement tool 30 is engaged within engagement recess 322 of engagement screw 300 and is manipulated, e.g., rotated, to move engagement screw 300 radially outwardly relative to fastener 100 from the extended position back to the retracted position, thereby disengaging fastener 100 from rod 20 and allowing fastener 100 to be removed from rod 20 via passage 122 of mouth 120.

From the foregoing and with reference to the various figure drawings, those skilled in the art will appreciate that certain modifications can also be made to the present disclosure without departing from the scope of the same. While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed:

1. A fastener for engagement about a threaded rod, the fastener comprising:

a body defining a central aperture centrally therethrough and an insertion opening defined therethrough in communication with the central aperture, the body including a threaded inner surface defining at least a portion of the central aperture, the threaded inner surface extending approximately 180 degrees about the central aperture, the body further defining a transverse aperture extending radially inwardly from an outer peripheral surface of the body in general alignment with the transverse aperture and in communication with the central aperture; and an engagement screw selectively engagable within the transverse aperture of the body and movable relative to the body between a retracted position, wherein an inner end of the engagement screw is disposed within the transverse aperture of the body, and an extended position, wherein the inner end of the engagement screw extends radially inwardly towards the threaded inner surface of the body for centrally engaging a threaded rod within the central aperture of the body between the threaded inner surface of the body and the engagement screw, wherein, in the extended position, the engagement screw and the threaded surface are disposed in general opposition relative to one another to engage a threaded rod therebetween.

2. The fastener according to claim 1, wherein the engagement screw is threadingly engaged within the transverse aperture.

3. The fastener according to claim 1, wherein an outer end of the engagement screw includes a tool-receiving recess defined therein that is configured to receive an engagement tool to facilitate movement of the engagement screw between the retracted position and the extended position.

4. The fastener according to claim 1, wherein the insertion opening defines a longitudinal axis that is offset relative to a radial line segment defined through the body and extending centrally through the transverse aperture by an oblique angle.

5. The fastener according to claim 4, wherein the oblique angle is approximately 45 degrees.

6. The fastener according to claim 4, wherein the insertion opening includes a mouth that extends inwardly from the outer peripheral surface of the body into communication with the central aperture, the mouth configured to facilitate insertion of a threaded rod therethrough and into the central aperture of the body.

7. The fastener according to claim 1, wherein the insertion opening includes an offset aperture partially overlapping the central aperture and offset from a center of the body, the offset aperture generally aligned between the center of the body and the transverse aperture.

8. The fastener according to claim 7, wherein, in the extended position, the engagement screw extends centrally through the offset aperture to centrally engage a rod within the central aperture between the threaded surface of the body and the engagement screw.

9. The fastener according to claim 1, further comprising a groove defined within and extending about the outer peripheral surface of the body.

10. The fastener according to claim 9, wherein the groove is configured to releasably engage a clip therein, the clip configured for positioning about an item suspended from the rod via the body of the fastener to substantially inhibit movement of the item relative to the rod.

11. The fastener assembly according to claim 10, wherein the fastener further includes a groove defined within and extending about the outer peripheral surface thereof, the groove configured to releasably engage the fastener-engaging portion of the clip therein.

12. The fastener assembly according to claim 11, wherein the fastener-engaging portion of the clip includes first and second resilient arms configured to snap into engagement within the groove of the fastener.

13. A fastener for engagement about a rod, the fastener comprising:

a body defining an upper surface, a lower surface, and an outer peripheral surface, the body defining a central aperture that is centered about a center of the body and extends between the upper and lower surfaces thereof, the body defining a mouth that extends inwardly from the outer peripheral surface thereof into communication with the central aperture, the body defining a transverse aperture that extends radially inwardly from the outer peripheral surface thereof, the transverse aperture disposed in communication with the central aperture and the mouth, wherein the mouth is configured to facilitate insertion of a rod therethrough and into the central aperture of the body, the mouth extending inwardly from the outer peripheral surface of the body at an oblique angle relative to a radial line segment defined through the body and extending centrally through the transverse aperture; and an engagement screw selectively engagable within the transverse aperture of the body and movable relative to the body between a retracted position, wherein an inner end of the engagement screw is disposed within the transverse aperture of the body, and an extended position, wherein the inner end of the engagement screw extends radially inwardly into the mouth of the body to centrally engage a rod within the central aperture between an inner surface of the body that defines the central aperture and the inner end of the engagement screw.

14. The fastener according to claim 13, wherein the engagement screw is threadingly engaged within the transverse aperture.

15. The fastener according to claim 13, wherein an outer end of the engagement screw includes a tool-receiving recess defined therein that is configured to receive an engagement tool therein to facilitate movement of the engagement screw between the retracted position and the extended position.

16. The fastener according to claim 13, wherein the inner surface of the body that defines the central aperture extends approximately 180 about the central aperture and is generally aligned with the transverse aperture such that the inner surface of the body and the engagement screw engage the rod therebetween in general opposition to one another.

17. The fastener according to claim 13, wherein the oblique angle is approximately 45 degrees.

18. The fastener according to claim 13, wherein the inner surface of the body that defines the central aperture is threaded to facilitate engagement with a threaded rod.

19. The fastener according to claim 13, wherein an elbow is defined at the interface between the mouth and the central aperture of the body.

20. The fastener according to claim 13, further comprising a groove defined within and extending about the outer peripheral surface of the body.

21. The fastener according to claim 20, wherein the groove is configured to releasably engage a clip therein, the clip configured for positioning about an item suspended from the rod via the body of the fastener to substantially inhibit movement of the item relative to the rod.

22. A fastener assembly for suspending an item from a rod, the fastener assembly comprising:

a fastener configured for positioning about a rod, the fastener releasably engagable with the rod for retaining the fastener in fixed position relative to the rod the faster defining a central aperture that is configured to receive the rod therein and a transverse aperture in communication with the central aperture, the faster further including an engagement screw selectively engagable within the transverse aperture and moveable relative to the fastener between a retracted position, wherein an inner end of the engagement screw is disposed within the transverse aperture of the fastener, and an extended position, wherein the inner end of the engagement screw extends radially inwardly towards the central aperture to centrally engage the rod within the central aperture between an inner surface of the body that defines the central aperture and the inner end of the engagement screw; and a clip including a fastener-engaging portion configured for engagement about the fastener, a rod-engaging portion configured for engagement about the rod, and an connecting portion interconnecting the fastener-engaging portion and the rod-engaging portion, the clip configured for positioning about an item suspended from the rod via the fastener to substantially inhibit movement of the item relative to the rod.

23. The fastener assembly according to claim 22, wherein the fastener further defines a mouth that extends inwardly from the outer peripheral surface thereof into communication with the central aperture, the mouth configured to facilitate insertion of the rod therethrough and into the central aperture of the body.

24. The fastener assembly according to claim 23, wherein the mouth extends inwardly from the outer peripheral surface of the body and defines a longitudinal axis that is offset relative to a radial line segment defined through the body and extending centrally through transverse aperture by an oblique angle.

25. The fastener assembly according to claim 22, wherein the fastener further defines an offset aperture that partially overlaps the central aperture, the offset aperture configured to receive the rod therein and to permit free translation of the fastener along the rod when the rod is disposed within the offset aperture.

26. The fastener assembly according to claim 22, wherein the clip is formed from a single piece of wire.

* * * * *